US007930856B2

(12) United States Patent
Hooper, Jr.

(10) Patent No.: US 7,930,856 B2
(45) Date of Patent: Apr. 26, 2011

(54) ADA COMPLIANT SILLS HAVING A COLLAPSIBLE WEATHER-STRIP FOR USE WITH SLIDING DOOR ASSEMBLIES

(75) Inventor: William J. Hooper, Jr., Lawrenceville, GA (US)

(73) Assignee: Alcoa Inc., Pittsburgh, PA (US)

( * ) Notice: Subject to any disclaimer, the term of this patent is extended or adjusted under 35 U.S.C. 154(b) by 362 days.

(21) Appl. No.: 12/059,520

(22) Filed: Mar. 31, 2008

(65) Prior Publication Data

US 2009/0241428 A1 Oct. 1, 2009

(51) Int. Cl.
*E05D 15/16* (2006.01)

(52) U.S. Cl. ..... 49/411; 49/469; 52/204.51

(58) Field of Classification Search ..... 49/467, 49/469, 411, 410; 52/204.51, 207
See application file for complete search history.

(56) References Cited

U.S. PATENT DOCUMENTS

| | | | | |
|---|---|---|---|---|
| 2,611,158 | A * | 9/1952 | Gregory | 49/305 |
| 2,718,677 | A | 9/1955 | Cornell | |
| 2,953,824 | A * | 9/1960 | Minick | 52/207 |
| 3,014,253 | A * | 12/1961 | Manville | 49/469 |
| 3,111,727 | A | 11/1963 | Gerecke | |
| 3,248,822 | A * | 5/1966 | Sincock | 49/425 |
| 3,304,658 | A | 2/1967 | Kreger | |
| 4,287,684 | A | 9/1981 | McKann | 49/468 |
| 4,528,788 | A | 7/1985 | Yackiw et al. | |
| 4,803,809 | A * | 2/1989 | Takemura | 49/404 |
| 5,001,865 | A * | 3/1991 | Procton | 49/469 |
| 5,029,911 | A | 7/1991 | Daniels | |
| 5,067,279 | A * | 11/1991 | Hagemeyer | 49/471 |
| 5,452,550 | A | 9/1995 | Vanesky et al. | |
| 5,671,967 | A * | 9/1997 | Gurganus et al. | 296/146.9 |
| 5,678,366 | A * | 10/1997 | Nambo et al. | 52/207 |
| 6,052,949 | A | 4/2000 | Procton et al. | |
| 6,061,967 | A * | 5/2000 | Judds | 49/469 |

(Continued)

FOREIGN PATENT DOCUMENTS

CA 2166377 11/1999

(Continued)

OTHER PUBLICATIONS

U.S. Appl. No. 12/186,897 for ADA Compliant Collapsible Threshold for Use With a Sliding Door Assembly, filed Aug. 6, 2008.

(Continued)

*Primary Examiner* — David Dunn
*Assistant Examiner* — David E Allred
(74) *Attorney, Agent, or Firm* — Greenberg Traurig, LLP

(57) ABSTRACT

Door sill frame assemblies and sliding door assemblies comprising the same are disclosed. In one embodiment, a sill frame assembly for a sliding door includes a first engaging surface capable of attaching with a sliding door and allowing lateral reciprocating motion of the sliding door and a second engaging surface, wherein along at least a first portion of the second engaging surface is attached a sill member and wherein along at least a second portion of the second engaging surface is attached a fixed-panel door, wherein the sill member includes a channel having a weather-strip extending upward from the channel, the weather-strip having a first open state for substantially preventing water and air intrusion past the sliding door when the sliding door is in a closed position and a second compact state for allowing accessibility of a wheelchair through an opening when the sliding door is in an open position.

11 Claims, 10 Drawing Sheets

U.S. PATENT DOCUMENTS

| | | | | |
|---|---|---|---|---|
| 6,253,505 | B1 * | 7/2001 | Wefringhaus et al. | 52/204.5 |
| 6,289,635 | B1 | 9/2001 | Procton et al. | |
| 6,345,477 | B1 * | 2/2002 | Kepler et al. | 52/204.1 |
| 6,871,448 | B1 | 10/2003 | Kline | |
| 6,883,279 | B2 * | 4/2005 | Fukuro et al. | 52/209 |
| 7,124,538 | B1 | 10/2006 | Kline | |
| 7,266,929 | B1 * | 9/2007 | Allred et al. | 52/211 |
| 7,290,371 | B2 * | 11/2007 | Zimmerman | 49/460 |
| 2006/0283090 | A1 | 12/2006 | Moody | |
| 2007/0101668 | A1 | 5/2007 | Snider et al. | |
| 2008/0028701 | A1 * | 2/2008 | White | 52/207 |
| 2009/0013623 | A1 * | 1/2009 | Snider et al. | 52/204.51 |
| 2010/0031578 | A1 * | 2/2010 | Hartwell | 49/468 |
| 2010/0064590 | A1 * | 3/2010 | Jones et al. | 49/469 |

FOREIGN PATENT DOCUMENTS

| | | | |
|---|---|---|---|
| GB | 2224299 | A * | 5/1990 |
| WO | WO 8403534 | A1 * | 9/1984 |

OTHER PUBLICATIONS

Official Action issued in connection with U.S. Appl. No. 12/186,897 mailed Aug. 3, 2010.

* cited by examiner

ADA COMPLIANT SILLS HAVING A COLLAPSIBLE WEATHER-STRIP FOR USE WITH SLIDING DOOR ASSEMBLIES

BACKGROUND

Various types of access doors for dwellings are known. One such access door is a sliding door assembly which includes one movable panel (the sliding door) and one fixed-panel (the fixed-panel door). Sliding door assemblies are particularly utilizable in residential and business dwellings for their appearance and functionality however, unique problems exist with such sliding door assemblies. One such concern in the manufacture of sliding door assemblies is the door sill. The sill is that portion of the assembly which provides the threshold over which one passes when passing through the door closure. Local building codes often specify sills that are tall, in order to block entry of water into the interior of the dwelling between the door panels. For example, in some states, sill requirements are often a few inches in height. These height requirements have not taken into consideration the handicapped or otherwise wheelchair person in mind. There are numerous instances of conflict between building codes requiring such barriers to prevent damages from water penetration and federal regulations covering ADA (Americans with Disabilities Act) Standards for Accessible design.

While sliding door assemblies adapted to be traversed by a wheelchair have been developed, and standards to handicap sills are set forth in the Americans with Disabilities Act (ADA) the evolution of handicap sills has generally not kept pace with that of standard sill assemblies. For example, many handicap sill assemblies fail to incorporate the water sealing technologies of standard assemblies and are thus susceptible to leaks between the sill and a closed door, particularly during wind blown rains. Further, currently available handicap sills are not designed to accommodate entryways with sliding doors.

SUMMARY OF THE DISCLOSURE

There is provided in one aspect a sill frame assembly comprising: a first engaging surface (also termed herein a track) capable of attaching with the sliding door and allowing lateral reciprocating motion of the sliding door along an entire length of the sill frame assembly; and a second engaging surface, wherein along at least a first portion of the second engaging surface is attached a sill member and wherein along at least a second portion of the second engaging surface is attached a fixed-panel door, wherein the sill member includes a channel having a weather-strip extending upward from the channel, the weather-strip having a first open state for substantially preventing water and air intrusion past the sliding door when the sliding door is in a closed position and a second compact state for allowing accessibility of a wheelchair through an opening when the sliding door is in an open position. In one embodiment, the sill frame assembly has an overall height equal to or less than about 0.75 inches.

In one embodiment, the sill frame assembly comprises a transitional element that protrudes vertically upwards from one end of the sill frame assembly and then angles upwards towards the first engaging surface.

In another embodiment, the sill frame assembly comprises at least one hole which extends through a thickness of a bottom surface of the sill frame assembly; and a drain tube capable of collecting water that seeps through the at least one hole.

In another aspect, the present invention provides a sliding door assembly that includes a sliding door movable between a closed position and an open position; a fixed-panel door maintained in a stationary position; and a door frame surrounding and supporting the sliding door and the fixed-panel door, wherein the door frame includes a bottom sill frame assembly having a first engaging surface (also termed herein a track) capable of attaching with the sliding door and allowing lateral reciprocating motion of the sliding door, a recess for maintaining the fixed-panel door in the stationary position, and a sill member having an opening parallel to the first engaging surface for housing a collapsible weather-strip, the collapsible weather-strip capable of being maintained in a sealed state when the sliding door is in the closed position and capable of collapsing into a compact state when the sliding door is in the open position.

BRIEF DESCRIPTION OF THE DRAWINGS

For a fuller understanding of the disclosure, reference is made to the following description taken in conjunction with the accompanying drawing(s) in which:

FIG. 1A is a perspective view of the sill frame assembly. FIG. 1B is a side cross-sectional view of the sill frame assembly of FIG. 1A;

FIG. 2A is a perspective view of the sill frame assembly. FIG. 2B is a side cross-sectional view of the sill frame assembly of FIG. 2A;

DETAILED DESCRIPTION

Figure 1A:
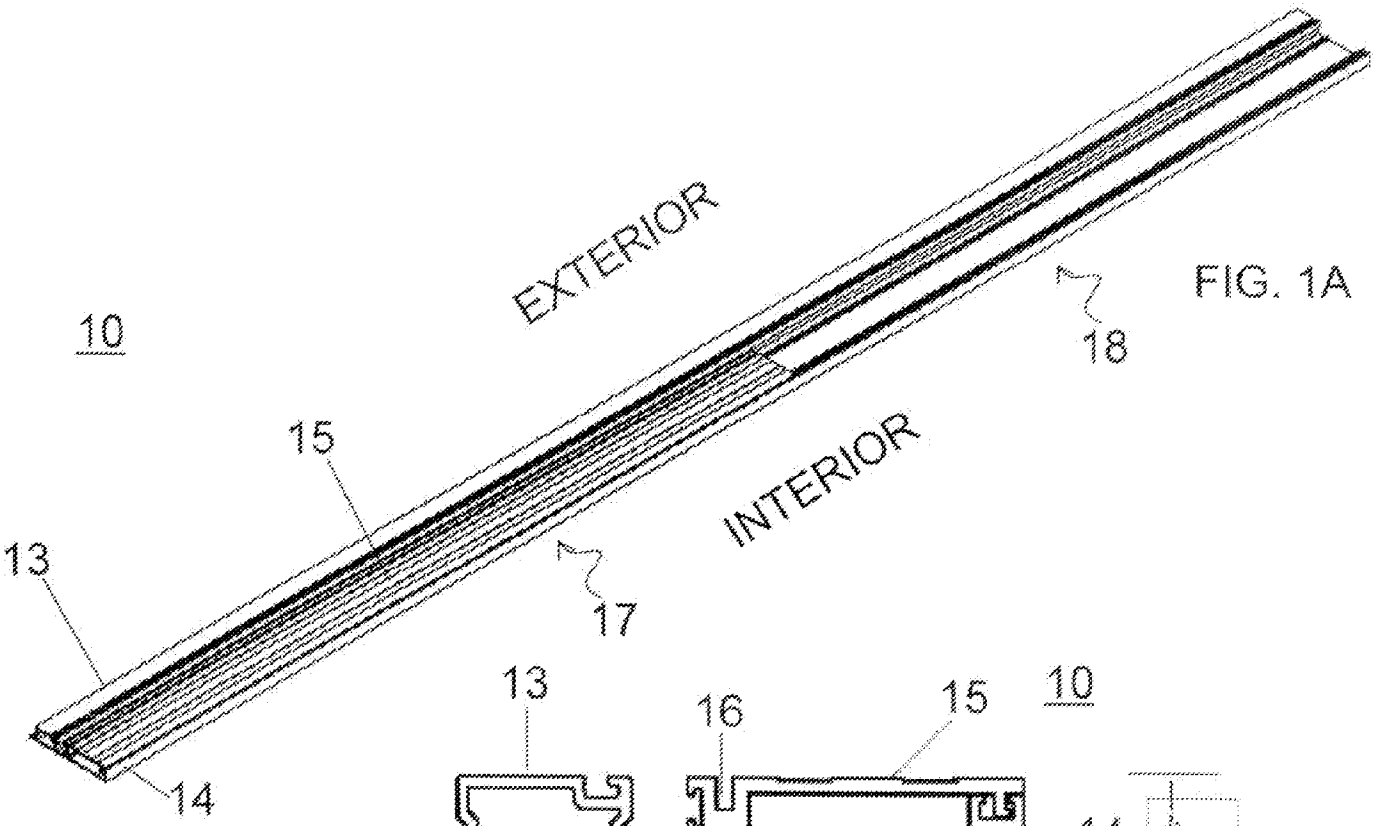
FIG. 1A-1B depicts one embodiment of a sill frame assembly of the present invention.

The present invention is now discussed in more detail referring to the drawings that accompany the present application. In the accompanying drawings, like and/or corresponding elements are referred to by like reference numbers. In one embodiment of the present invention, a sill frame assembly for a sliding door is provided that includes a first engaging surface capable of attaching with the sliding door and a second engaging having a sill member that includes a weather-strip. The weather-strip is maintained in an "open state", thus providing a positive barrier to air and water infiltration and is capable of collapsing into a "compact state" when downwards pressure is applied to the weather-strip. The sill frame assembly may optionally include a transitional element and a drainage system. In one embodiment, the sill frame assembly has an overall height equal to or less than about 0.75 inches. Each of the aspects of the first engaging surface, the second engaging surface, the sill member, and the weather-strip are now discussed in greater detail.

As used herein, the term "sill frame assembly" or "bottom sill frame assembly" means that portion of a door assembly that is susceptible to water penetration and acts as a threshold for entry through an opening created in a doorway.

As used herein, the term "lateral reciprocating motion" means sideways motion relative to a door frame that can repeat over and over again.

As used herein, the term "channel" means an opening or groove.

As used herein, the term "weather-strip" means a material or device used to seal an opening, such as an opening between the door panels of a sliding door assembly. The goal of a weather-strip is to prevent rain and water from entering the sliding door assembly by either blocking it outright or by blocking most of it and returning or rerouting it. A secondary goal of a weather-strip may be to keep interior air in, thus saving energy with heating and air conditioning.

As used herein, the term "open state" or "sealed state" means a state where a weather-strip is capable of providing weatherstripping functions.

As used herein, the term "compact state" means a state where a weather-strip has collapsed, or changed its shape, such that accessibility through an opening created in a sliding door assembly is achieved.

As used herein, the term "accessibility" means the degree to which a sliding door assembly allows access to people with disabilities.

As used herein, the term "Americans with Disabilities Act" or "ADA" means the civil rights law that prohibits, under certain circumstances, discrimination based on disability. Disability is defined as "a physical or mental impairment that substantially limits a major life activity." According to the current ADA Accessibility Guidelines, Section 4.13.8, Thresholds at Doorways, "Thresholds at doorways shall not exceed ¾ inch (19 mm) in height for exterior sliding doors . . . Raised thresholds and floor level changes at accessible doorways shall be beveled with a slope no greater than 1:2."

As used herein, the term "protrusion" means a part of a material or device that sticks out. In an embodiment of the invention, the weather-strip has a protrusion for engaging the channel of a sill member of the sill frame assembly.

As used herein, the term "angling upwards" means slanting upwards.

As used herein, the term "maintained" means to be kept in a steady or stationary position.

As used herein, the term "supporting" means bearing the weight of. In an embodiment of the invention, a door frame of a sliding door assembly is capable of supporting a sliding door and a fixed-panel door.

As used herein, the term "collapsing" means folding or changing shape. In an embodiment, a weather-strip is capable of collapsing such that the shape changes and accessibility through an opening created in a sliding door assembly is achieved.

As used herein, the term "engaging" or "engaged" means contacting or to make contact with something.

As used herein, the term "water and air infiltration" means the ability of water and/or air to move into an interior space.

Figure 1B:
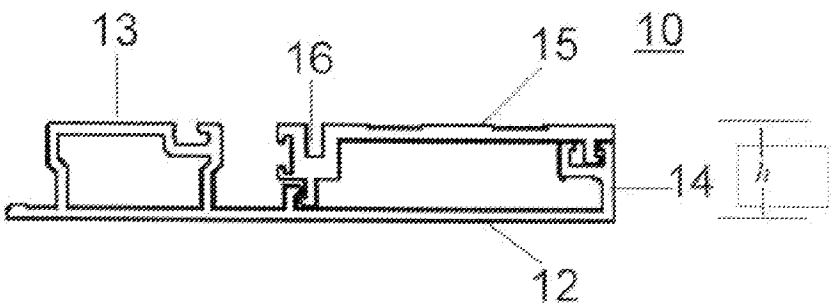

Referring to FIGS. 1A and 1B, in one embodiment, the sill frame assembly 10 comprises a bottom portion 12 having attached thereto and protruding upwards a first engaging surface 13 (also referred to as a track) and a second engaging surface 14. Along at least a first portion 17 of the second engaging surface 14 is attached a sill member 15 and along at least a second portion 18 of the second engaging surface 14 is attached a fixed-panel door (not shown). The sill member 15 includes a channel 16 to which a collapsible weather-strip (not shown) extends upwards from. The height h of the sill frame assembly 10 is chosen so that it meets current ADA height requirements for a door sill. In an embodiment, the sill frame assembly 10 has an overall height, h, equal to or less than about 0.75 inches. Those skilled in the art will recognize that the height h may vary according to current ADA height requirements. The first engaging surface 13 is capable of attaching with a sliding door (not shown) and allowing lateral reciprocating motion of the sliding door along an entire length of the sill frame assembly 10.

Figure 2A:
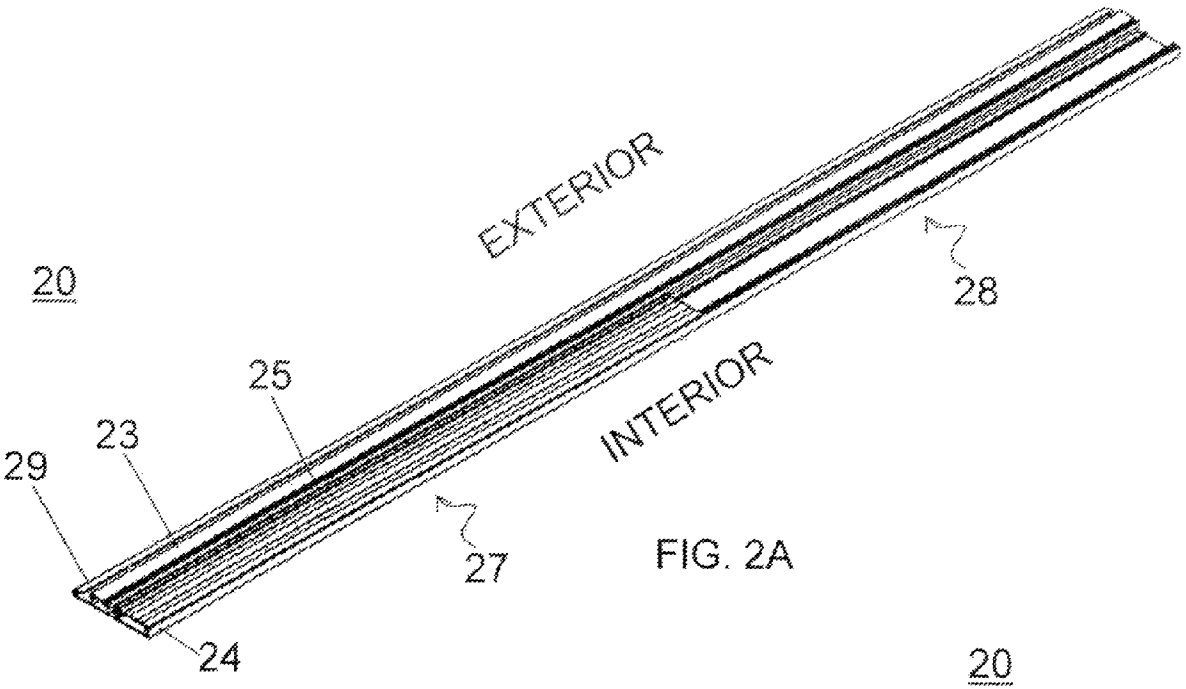
FIG. 2A-2B depicts another embodiment of a sill frame assembly of the present invention.
Figure 2B:
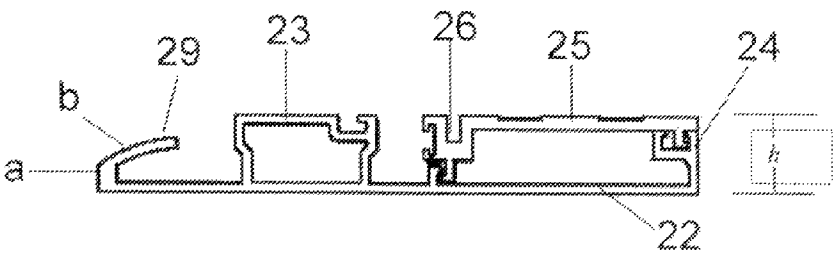

Referring to FIGS. 2A and 2B, in another embodiment, the sill frame assembly 20 comprises a bottom portion 22 having attached thereto and protruding upwards a first engaging surface 23 (also referred to as a track) and a second engaging surface 24. The sill frame assembly 20 may optionally include a transitional element 29 that protrudes vertically upwards from the bottom portion 22 at one end of the sill frame assembly 20 and then angles up and towards the first engaging surface 23. In an embodiment, the sill frame assembly 20 has an overall height, h, equal to or less than about 0.75 inches. In an embodiment, portion "a" of the transitional element 29 protrudes vertically upwards about 0.25 inches from the bottom portion 22, portion "b" angles up and towards the first engaging surface 23 such that the vertical height from one end of portion b to the other end of portion b is about 0.25 inches, and the height from a top end of the transitional element 29 to the first engaging surface 23 is about 0.25 inches, yielding an overall height, h, of about 0.75 inches. Along at least a first portion 27 of the second engaging surface 24 is attached a sill member 25 and along at least a second portion 28 of the second engaging surface 24 is attached a fixed-panel door (not shown). The sill member 25 includes a channel 26 to which a collapsible weather-strip (not shown) extends upward from. The first engaging surface 23 is capable of attaching with a sliding door (not shown) and allowing lateral reciprocating motion of the sliding door along an entire length of the sill frame assembly 20.

Figure 3:
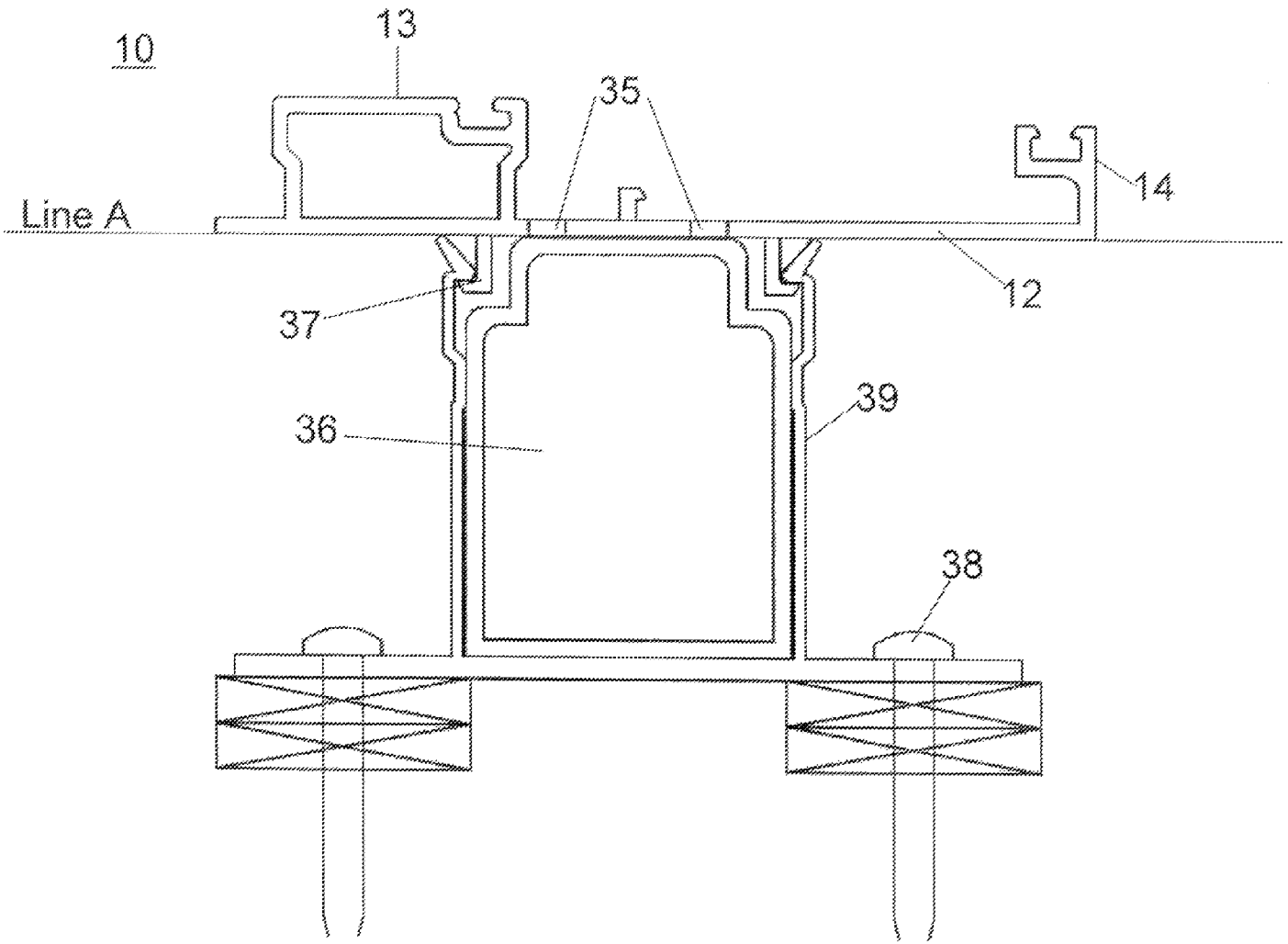
FIG. 3 is a side cross-sectional view of another embodiment of a sill frame assembly of the present invention.

Referring now to FIG. 3, in another embodiment of the present invention, the sill frame assembly 10 of FIG. 1A and FIG. 1B includes an extra feature for higher water performance capabilities. Line A drawn in FIG. 3 represents a differentiation between that portion of the sill frame assembly 10 that would be placed above a concrete slab and that portion which would be anchored within a chase formed in the slab. The bottom portion 12 includes at least one pair of snap legs 37 that protrudes a distance downwards into the slab and engages a mounting base 39 that attaches to the slab using fasteners 38. The sill frame assembly 10 has at least one weep hole 35 that extends through a thickness of the bottom portion 12 of the sill frame assembly 10 and connects with a drain tube 36 which lies within a space defined between the mounting base 39 and a bottom surface of the bottom portion 12. Any water and/or debris that seeps through the at least one weep hole 35 is collected in the drain tube 36. The drain tube 36 may also be connected to a drainage pipe (not shown) to provide drainage of any water and/or debris that has accumulated. Although the drain tube 36, mounting base 39 and weep hole 35 are shown with relation to the sill frame assembly 10 of FIGS. 1A and 1B, those skilled in the art will recognize that these elements may be used in the sill frame assembly 20 of FIGS. 2A and 2B, as well as any of the sills disclosed herein.

Figure 4:
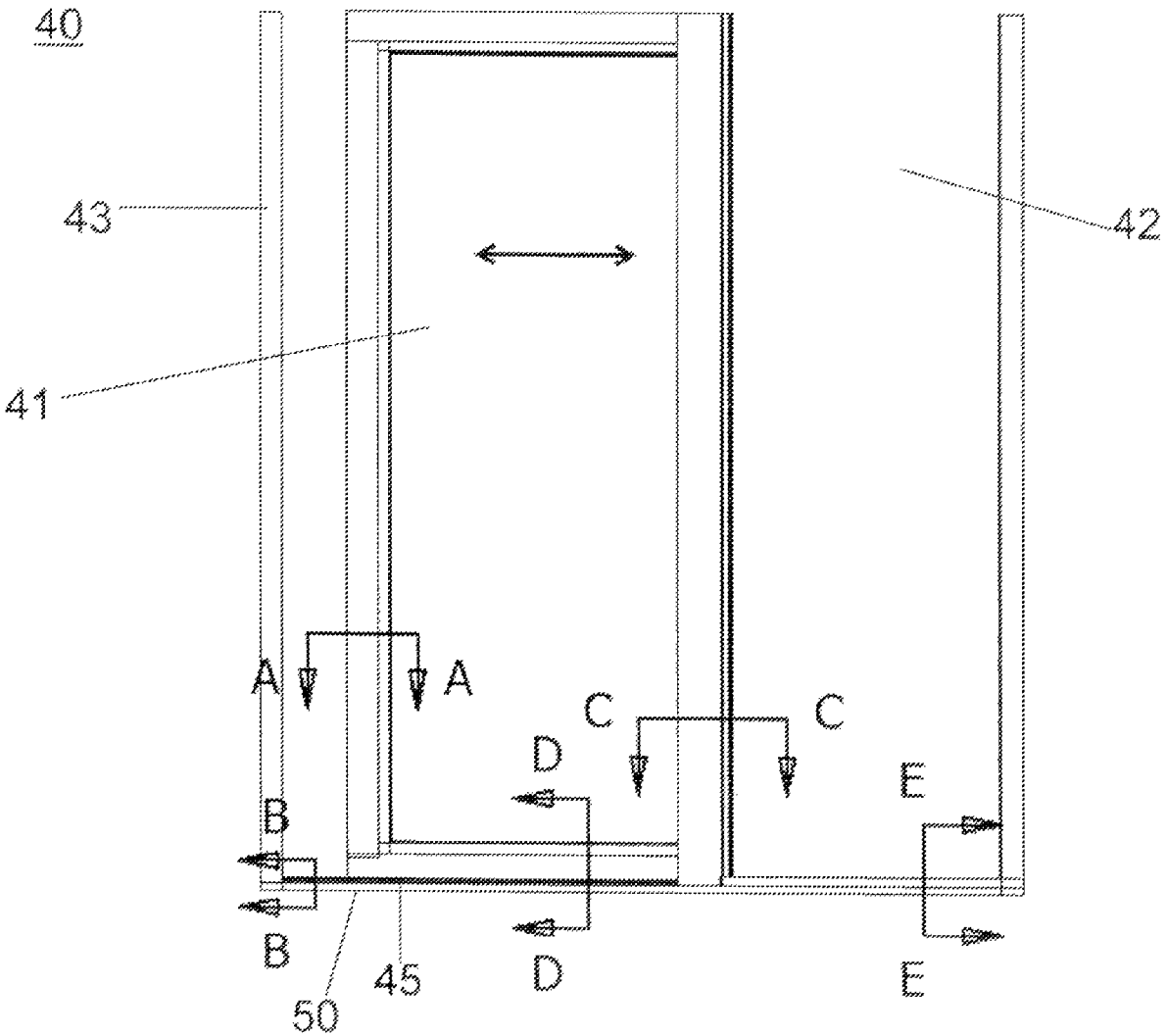
FIG. 4 is a partial front view of one embodiment of a sliding door assembly of the present invention.

Referring now to FIG. 4, as viewed from an interior of a building, in one embodiment a sill frame assembly 50 of the present invention is used in a sliding door assembly 40. The sliding door assembly 40 includes a sliding door 41, a fixed-panel door 42 and a door frame 43. The sliding door 41 is movable between a closed position and an open position. The fixed-panel door 42 is maintained in a stationary position. The door frame 43 surrounds and supports the sliding door 41 and the fixed-panel door 42 and includes the bottom sill frame assembly 50 having an overall height equal to or less than about 0.75 inches. The bottom sill frame assembly 50 has a track (also referred to as a first engaging surface, not visible in FIG. 4) for lateral reciprocating motion of the sliding door 41 in the direction of the arrows, a recess (not visible in FIG. 4) for maintaining the fixed-panel door 42 in the stationary position, and an opening (not visible in FIG. 4) parallel to the track for housing a collapsible weather-strip 45. In an embodiment, the collapsible weather-strip 45 is a gasket capable of moving from a "sealed" or "open" state to a "compact" state when the sliding door 41 is in the open position. As used herein, "sealed" or "open" state refers to the weather-strip (also referred to herein as a gasket) 45 capable of substantially preventing water and air intrusion past the sliding door 41, especially when the sliding door 41 is in the closed position. As used herein, "compact" state refers to the gasket 45 capable of allowing accessibility of a wheelchair through an opening when the sliding door 41 is in the open position, as described in detail below.

Figure 5:
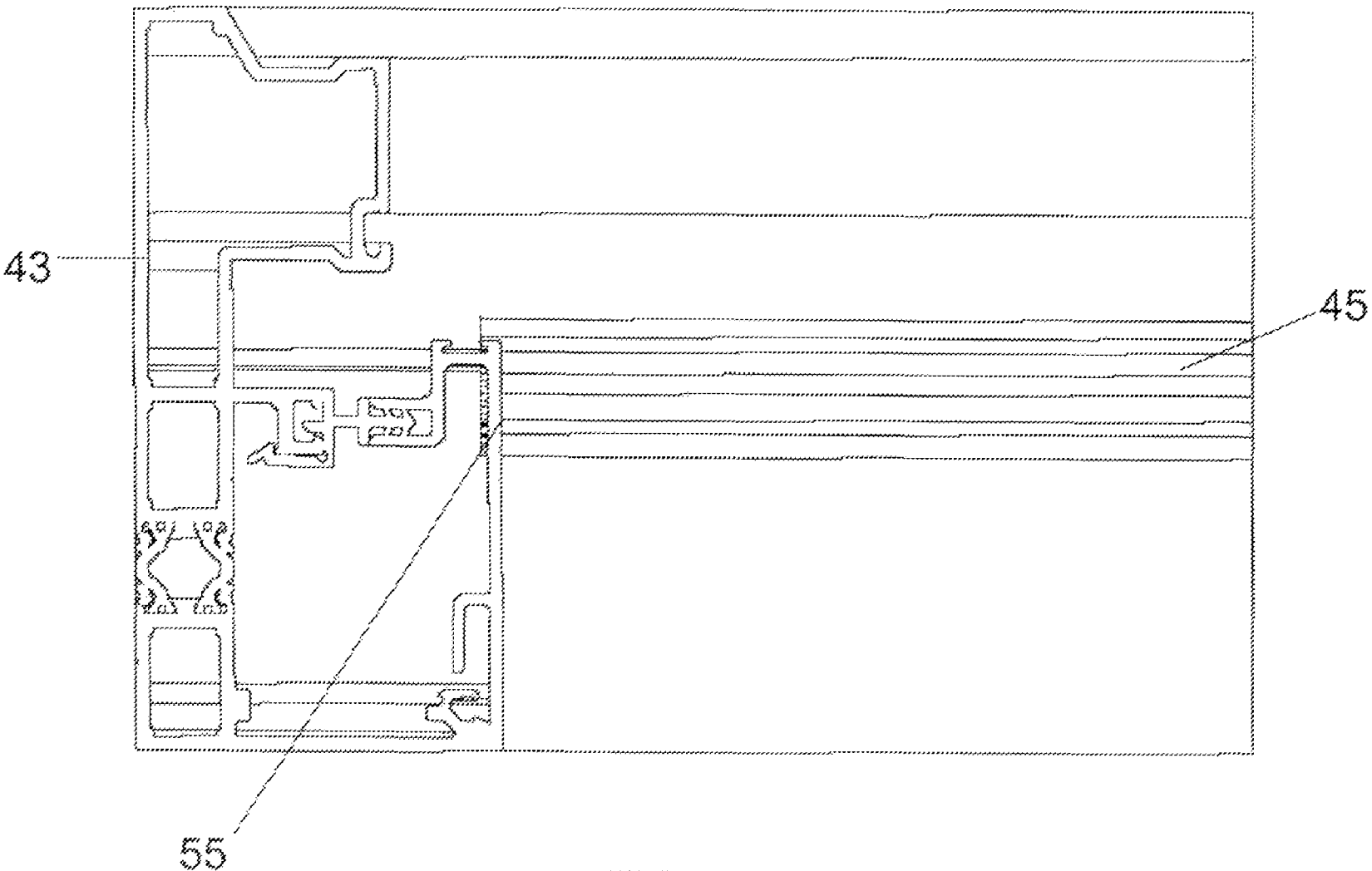
FIG. 5 is a fragmentary cross-sectional plan view of the sliding door assembly of FIG. 4 taken along line A-A.

FIG. 5 illustrates a fragmentary cross-sectional plan view of the sliding door assembly 40 of FIG. 4 taken along line A-A. In an embodiment, the collapsible gasket 45 is engaged at one end to the fixed-panel door 42 using a retainer clip (not shown in FIG. 5) and at the other end to a lock jamb 55 of the door frame 43 using a retainer clip (not shown in FIG. 5).

Figures 6A, 6B:
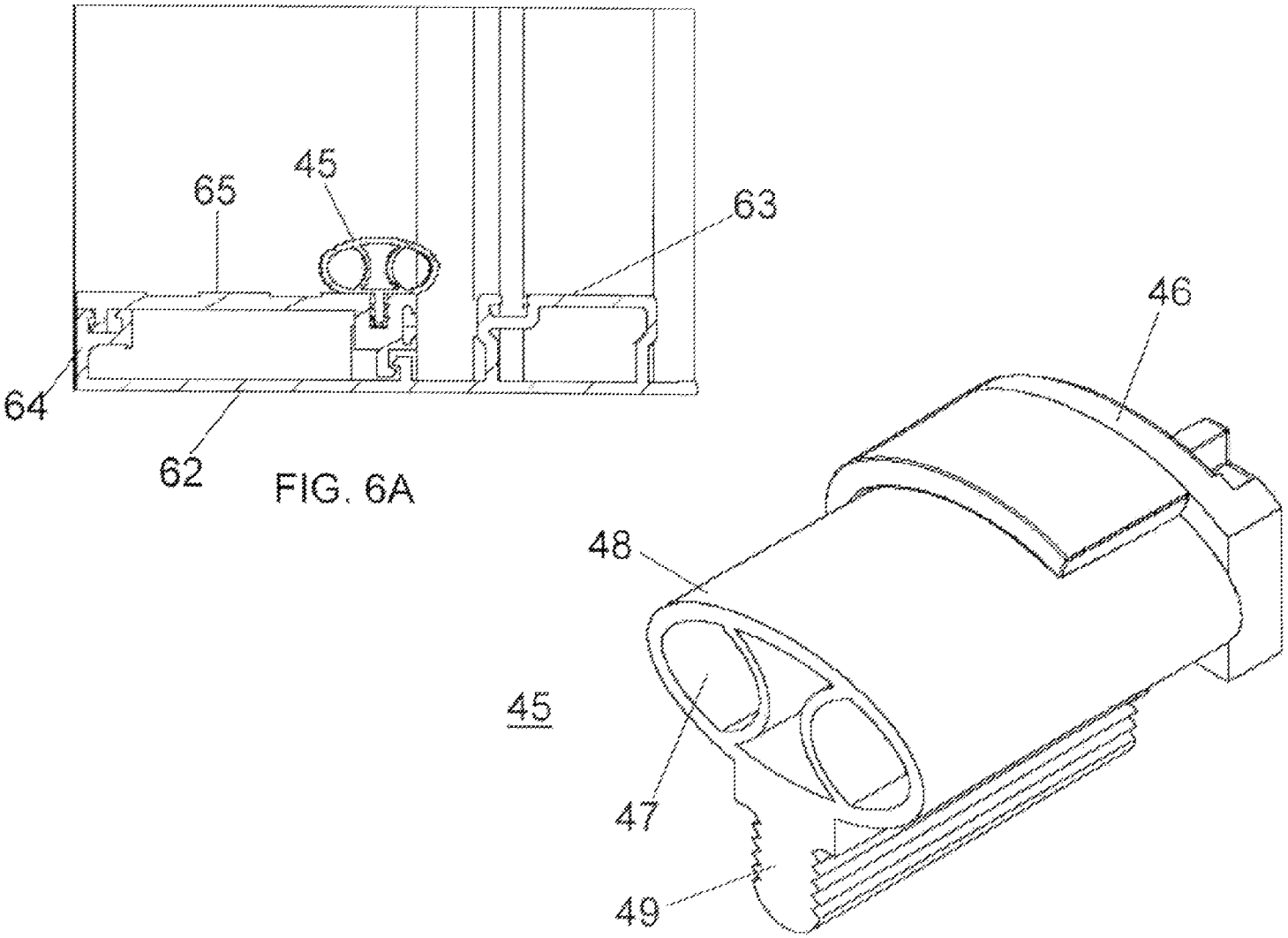
FIG. 6A is a fragmentary cross-sectional view of a bottom sill frame assembly of the sliding door assembly of FIG. 4 taken along line B-B.
FIG. 6B is a close-up cut-away view depicting an embodiment of a collapsible weather-strip.

FIG. 6A depicts a fragmentary cross-sectional elevation of the sliding door assembly 40 of FIG. 4 taken along line B-B. The bottom sill frame assembly 50 includes a bottom portion 62 having attached thereto and protruding upwards the first engaging surface 63 for lateral reciprocating motion of the sliding door 41 and a second engaging surface 64. A sill member 65 housing the collapsible gasket 45 is attached to the second engaging surface 64.

FIG. 6B shows a close-up cut-away view of an embodiment of the collapsible gasket 45. The collapsible gasket 45 has an outer surface 48 that includes at least one protrusion 49 for engaging the channel of the sill member 65. The collapsible gasket 45 is attached at one end to the fixed-panel door 42 and at the other end to the lock jamb 55 using retainer clips 46 (only one retainer clip 46 is shown in this cut-away view of the collapsible gasket 45). The collapsible gasket 45 includes inner cavities 47 for shape retention. The collapsible gasket 45 may be fabricated from any material that is resistant to harsh environmental elements (e.g., heat, oxidation, ozone and weather aging) and is capable of flexing when pressure is applied to the collapsible gasket 45. In an embodiment, the collapsible gasket 45 is fabricated from polypropylene material. For example, suitable polypropylene materials include, but are not limited to, ethylene-propylene rubbers and elastomers (also called EPDM and EPM). Ethylenepropylene rubbers are valuable for their excellent resistance to heat, oxidation, ozone and weather aging due to their stable, saturated polymer backbone structure. Those skilled in the art will recognize that many materials are suitable for use in fabricating the collapsible gasket 45 and are within the scope and spirit of the presently disclosed embodiments. The collapsible gasket 45 may include a door seal on the outer surface 48 which may seal any gaps that may be present between the collapsible gasket 45 and the sliding door 41. In an embodiment, the door seal is a magnetic strip for magnetically sealing.

Figure 7:
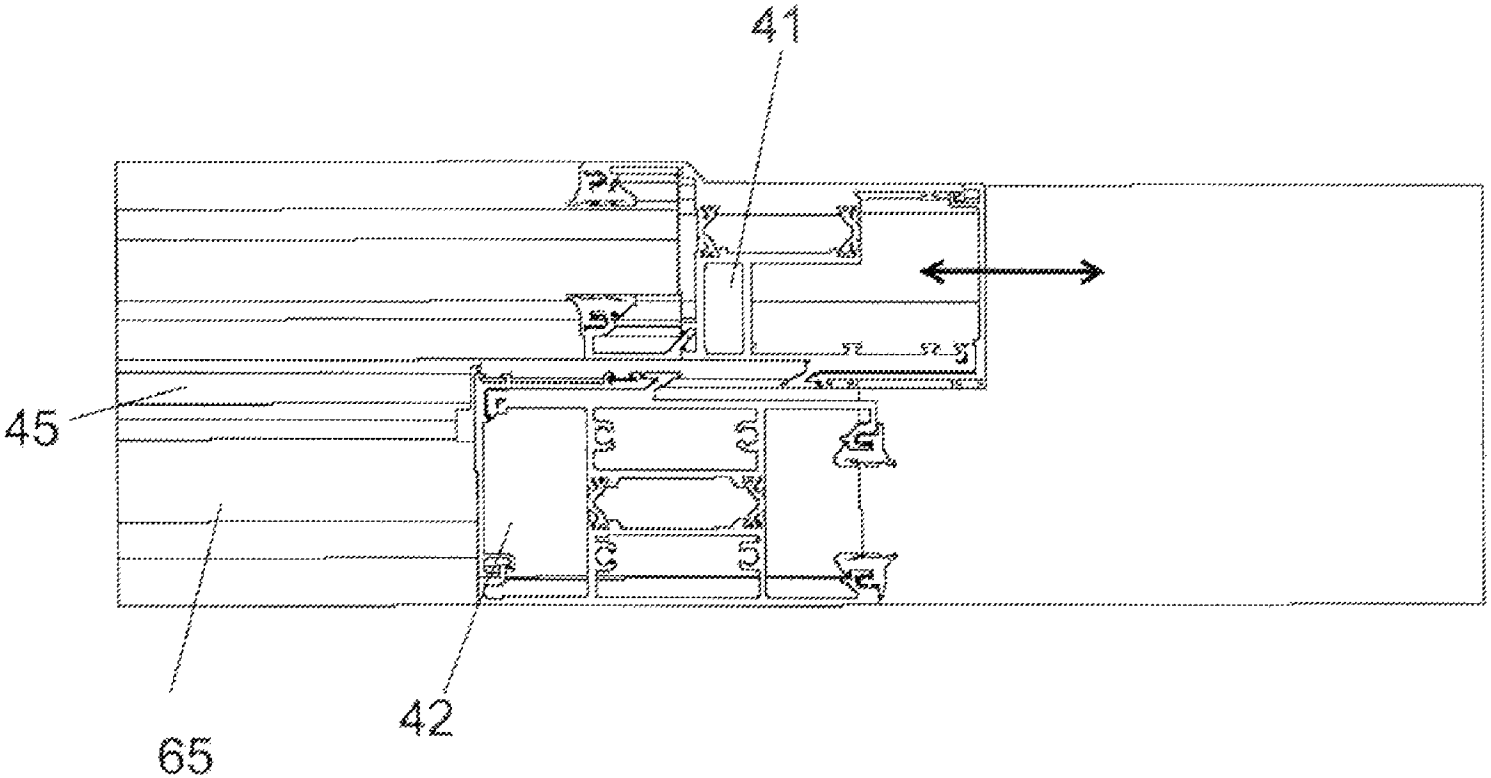
FIG. 7 is a fragmentary cross-sectional plan view of some of the main components of the sliding door assembly of FIG. 4 taken along line C-C.

FIG. 7 shows a fragmentary cross-sectional plan view of some of the main components of the sliding door assembly 40 of FIG. 4 taken along line C-C. As shown in FIG. 7, the sill member 65 housing the collapsible gasket 45 is engaged at one end to the fixed-panel door 42. The sliding door 41 moves along the entire length of the first engaging surface 63 behind the sill member 65 and the fixed-panel door 42 in the direction of the arrows.

Figure 8:
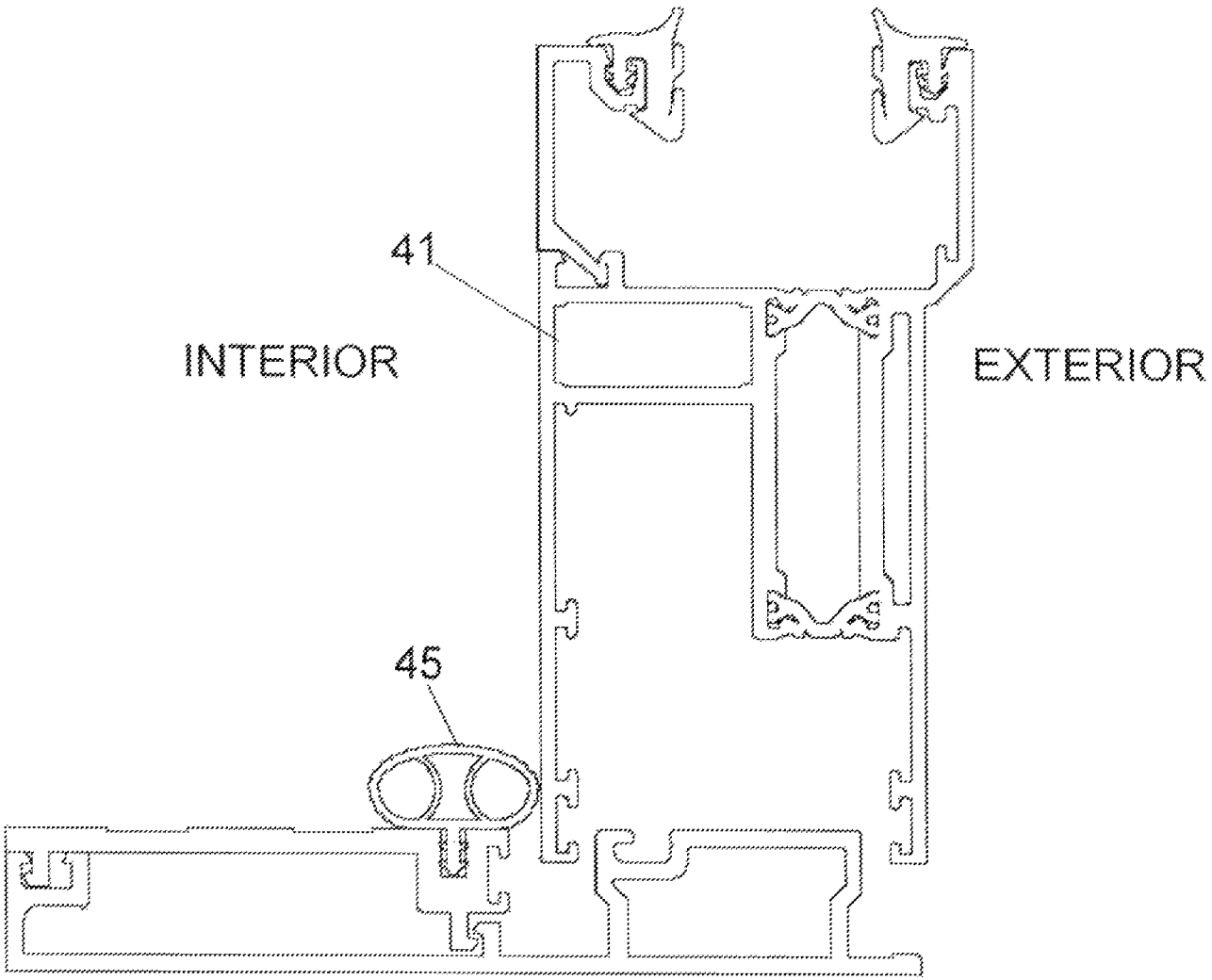
FIG. 8 is a fragmentary cross-sectional view of the sliding door assembly of FIG. 4 taken along line D-D.

FIG. 8 shows a fragmentary cross-sectional elevation of the sliding door assembly 40 of FIG. 4 taken along line D-D showing the placement of the sliding door 41 with relation to the collapsible gasket 45. The collapsible gasket 45 as shown in FIG. 8 is in the sealed or open state.

Figure 9:
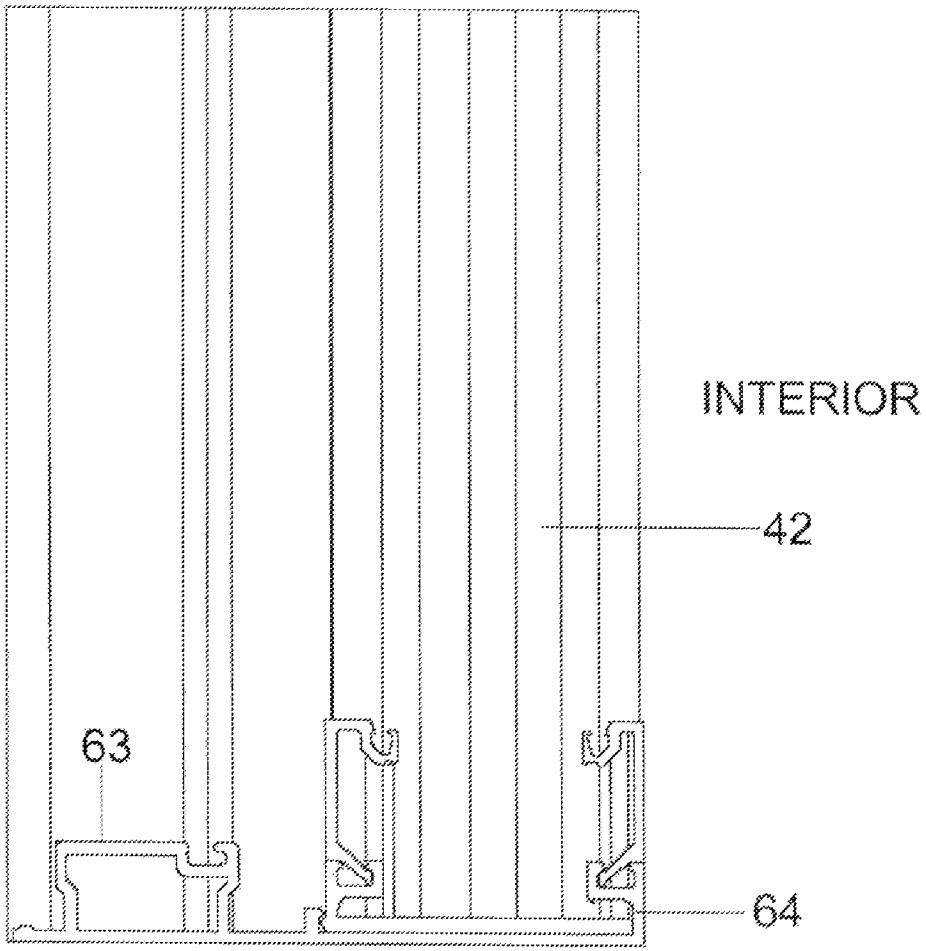
FIG. 9 is a fragmentary cross-sectional view of the sliding door assembly of FIG. 4 taken along line E-E.

FIG. 9 shows a fragmentary cross-sectional elevation of the sliding door assembly of FIG. 4 taken along line E-E showing the fixed-panel door 42 in place within a recess of the second engaging surface 64.

Figure 10:
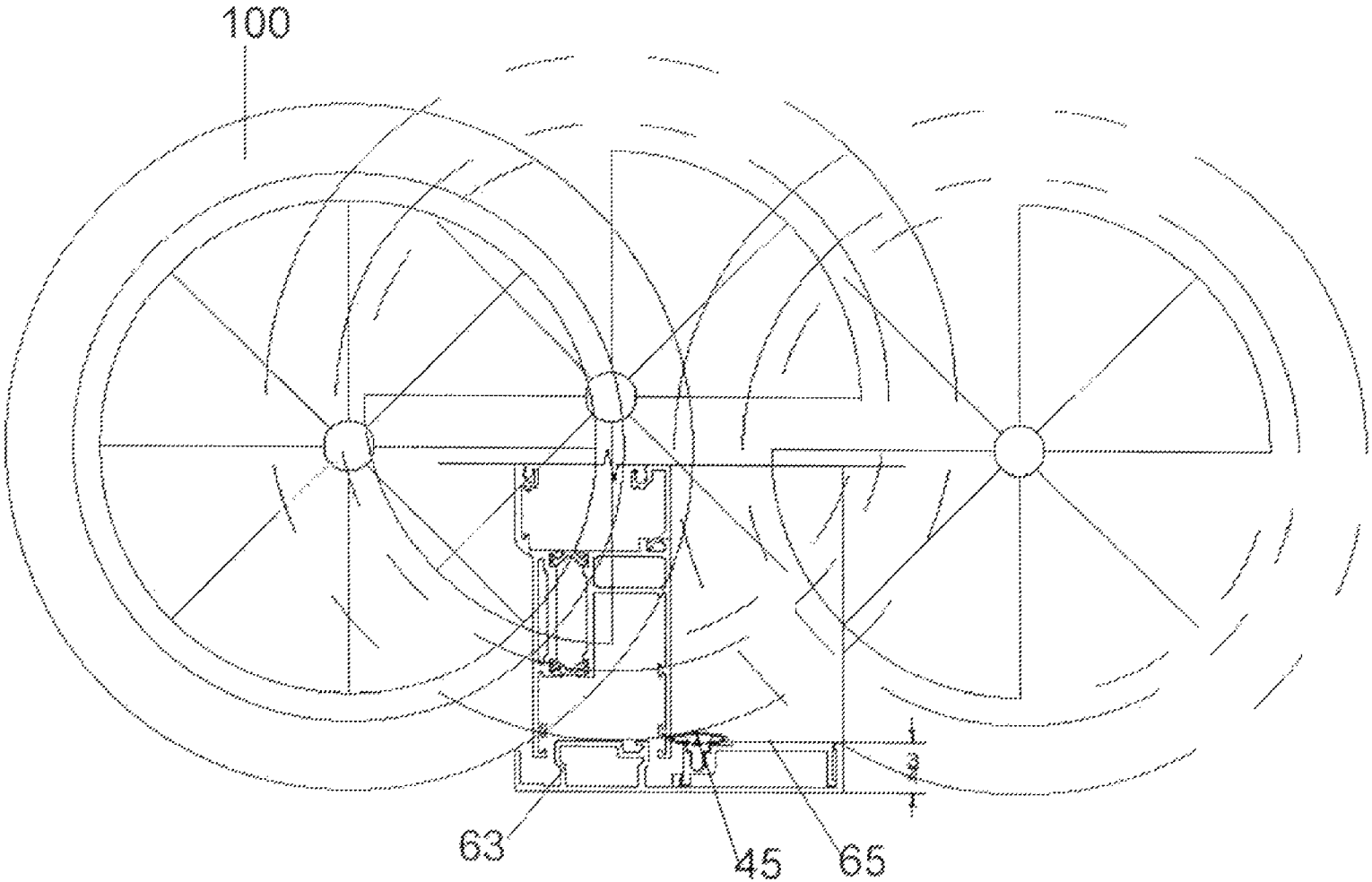
FIG. 10 is a close-up view of the bottom sill frame assembly of FIG. 6 during use. Pressure from a wheelchair tire moving across the bottom sill frame assembly causes the collapsible weather-strip to compress.

FIG. 10 is a close-up view of the bottom sill frame assembly 50 of FIG. 6 during use. The collapsible gasket 45 moves from the open state to the compact state after a wheelchair moves over it. First, the sliding door is moved to an open position such that an opening is created for the wheelchair to move through. "Open position" refers to the sliding door moving towards and behind the fixed-panel door. In this open position, a tire 100 from the wheelchair is capable of passing over the sill member 65 and exerting a downward pressure on the collapsible gasket 45 causing the collapsible gasket 45 to move from the open state to the compact state. Since the height of the bottom sill frame assembly 50 is equal to or less than about 0.75 inches, the bottom sill frame assembly 50 meets the ADA height requirements for a door sill.

While illustrative embodiments of the invention are disclosed herein, it will be appreciated that numerous modifications and other embodiments may be devised by those skilled in the art. Therefore, it will be understood that the appended claims are intended to cover all such modifications and embodiments that come within the spirit and scope of the present invention.

What is claimed is:

1. A sliding door assembly comprising:

a sliding door movable between a closed position and an open position;

a fixed-panel door maintained in a stationary position; and a door frame surrounding and supporting the sliding door and the fixed-panel door, wherein the door frame includes a bottom sill frame assembly having a first engaging surface capable of attaching with the sliding door and allowing lateral reciprocating motion of the sliding door, a recess in the bottom sill frame assembly outwardly of the first engaging surface, the recess for maintaining the fixed-panel door in the stationary position in a plane outward from the first engaging surface, and the bottom sill frame assembly comprising a sill member in the plane of the fixed panel door, the sill member housing a collapsible bulbous weather-strip, the collapsible weather-strip maintained in a sealed state with a surface facing inwardly of the collapsible bulbous weather-strip engaging the sliding door when the sliding door is in the closed position, and flexing outward and collapsing downward towards the sill member when pressure is applied to the collapsible weather-strip so as to change into a compact state when the sliding door is in the open position.

2. The sliding door assembly of claim 1, wherein the collapsible weather-strip is engaged at one end to the fixed-panel door.

3. The sliding door assembly of claim 1, wherein when the sliding door is in the closed position the collapsible weather-strip is maintained in the sealed state and substantially prevents water and air infiltration into a building having the sliding door assembly.

4. The sliding door assembly of claim 1, wherein the pressure applied to the collapsible weather-strip is a result of a wheelchair tire moving over the collapsible weather-strip.

5. The sliding door assembly of claim 1, wherein the bottom sill frame assembly has an overall height equal to or less than about 0.75 inches when the collapsible weather-strip is in the compact state.

6. The sliding door assembly of claim 1, wherein the collapsible weather-strip has an outer surface including at least one protrusion for engaging the opening of the bottom sill frame assembly.

7. The sliding door assembly of claim 1, wherein the bottom sill frame assembly further comprises a transitional element protruding vertically upwards from one end of the bottom sill frame assembly and then angling upwards towards the track.

8. The sliding door assembly of claim 1, wherein the bottom sill frame assembly further comprises:

at least one hole which extends through a thickness of a bottom portion of the bottom sill frame assembly; and a drain tube that connects with the at least one hole.

9. The sliding door assembly of claim 1, wherein the collapsible weather-strip is made from a polypropylene material.

10. The sliding door assembly of claim 1, wherein the collapsible weather-strip is made from ethylene propylene diene.

11. The sliding door assembly of claim 1, wherein the collapsible weather-strip extends along an entire length of the sill member.

* * * * *